United States Patent [19]

Ladisa

[11] Patent Number: 4,811,518

[45] Date of Patent: Mar. 14, 1989

[54] DOOR

[76] Inventor: Nicholas F. Ladisa, 10296 Quiet Pond Ter., Burke, Va. 22015

[21] Appl. No.: 935,935

[22] Filed: Nov. 28, 1986

[51] Int. Cl.[4] ..... E05D 7/02

[52] U.S. Cl. ..... 49/193; 49/382

[58] Field of Search ..... 49/382, 192, 193; 16/231, 232; 105/281

[56] References Cited

U.S. PATENT DOCUMENTS

| | | | |
|---|---|---|---|
| 1,774,199 | 8/1930 | Good | 49/193 |
| 3,048,899 | 8/1962 | Vincent | 49/193 |

FOREIGN PATENT DOCUMENTS

| | | | |
|---|---|---|---|
| 137719 | 6/1950 | Australia | 49/193 |
| 217062 | 2/1961 | Fed. Rep. of Germany | 49/193 |
| 1157240 | 5/1958 | France | 49/192 |
| 0155638 | 12/1979 | Japan | 49/193 |

*Primary Examiner*—Kenneth J. Dorner
*Assistant Examiner*—Gerald A. Anderson
*Attorney, Agent, or Firm*—Depaoli & O'Brien

[57] ABSTRACT

A double-action door can be opened along either side edge and in either direction by pushing or by pulling. A pair of vertically disposed and vertically slideable rods is mounted within the door and near each side edge. Each rod has a ball at its outer end and a horizontally operable cam at its inner end. A transverse bar is slideably mounted within the door and is adapted for interacting with all of the horizontally operable cams. Opening the door at one side edge causes the other side edge to function as the hinge edge. The rods near the opened edge move inwardly, as balls are cammed over the lintel and the sill, and the inner ends of the rods force the transverse bar to move sidewardly and simultaneously to force the rods at the hinge side to move outwardly so that their outer ends are firmly seated in cams in the lintel and in the sill. A locking mechanism is also disclosed which insets a pin into the transverse bar when the door is opened and which unlocks by camming over the lintel when the door is closed.

13 Claims, 2 Drawing Sheets

DOOR

BACKGROUND OF THE INVENTION

1. Field of the Invention

This invention relates to a pivotal door structure, and more particularly is directed toward a door structure adapted to open pivotally from either side.

2. Description of the Prior Art

Generally, a door structure pivotally opens from one side and is supported on hinges or the like on the other side. In many situations, it is desirable to be able to open a door, such as the door of a refrigerator or a cabinet, from either its left side or its right side in order to be able to avoid furniture and the like. In other situations, such as doors within a hallway, it may be desirable to open the door from either side and in either direction. Further, it is highly desirable to be able to open emergency exit doors by pushing on either side and without using handles.

A car door is described in U.S. Pat. No. 613,495 wherein a generally upright lever is pivoted about its fulcrum and moves a pair of rods in a generally horizontal direction to pivot four upright bolts about their fulcrums and thereby move four horizontally disposed bolts inwardly or outwardly of metallic keepers, arranged in suitable relation thereto on the door-jams, for respectively opening or locking a freight-car door.

U.S. Pat. No. 1,212,820 describes, particularly in its FIGS. 3–5, a locking cam comprising a circular plate which is turned by an actuating handle and carries a pair of pivotal connections at its edge which engage the ends of two horizontally disposed arms and also carries a third pivotal connection which engages cams along the inner edges of the arms, whereby revolving the actuating handle causes the plate to rotate and the two arms to be cammed inwardly or outwardly for opening or locking a door of a grain car.

A door mounting mechanism is described in U.S. Pat. No. 1,550,205 which comprises an operating handle for rotating an operating link on a pivot, thereby sliding a pair of bar members inwardly or outwardly, whereby a pivotal connection with sockets is released or formed, respectively, on either side of a door so that the door can be swung from either side and cannot be detached from both sides simultaneously.

U.S. Pat. No. 2,261,147 describes a disconnectible hinge structure which supports a refrigerator door so that it may be opened from either side. This structure comprises a pair of cooperating hinge elements which may be moved into operating position on a hinge axis and which have thrust and radial bearing means for supporting the load of the door. One of the hinge elements is secured to the edges of the door; the other is connected to the door frame. They are also relatively movable so that a recess formed in one of them will receive a projection formed in the other, thereby producing a pin and socket interengagement on which the door may be cooperatively swung from closed to open position with releaseable latch means.

U.S. Pat. No. 2,783,115 describes a cabinet having a door which is connected by means of a pair of hinges at its first side to the corresponding side of an upper panel which is in turn connected at its second side to the corresponding side of the cabinet. The door is further connected along its second side by means of a pair of hinges to a corresponding side of a lower panel which is in turn connected by means of a pair of hinges on its first side to the corresponding side of the cabinet. When the door is opened along its second side, it brings with it the upper panel. When the door is opened along its first side, it brings with it the lower panel. The contents of the upper part or of the lower part of the compartment may thereby be selectively observed.

A double action pivoting door is described in U.S. Pat. No. 3,048,899. The door comprises a push-pull handle, having a V-groove in the midway position of its shaft, which is disposed along each edge. Upper and lower vertical shafts are aligned with the V-groove of each handle, and each vertical shaft has a ball at its end which engages the V-groove on opposite sides thereof. Upper and lower horizontal beams are also disposed in the door and have recesses in the end thereof which engage corresponding recesses in the respective upper and lower vertical shafts. The upper and lower horizontal beams further comprise a spherical indentation in their respective upper and lower edges near each end and a quadrantal recess between the end and the respective upper and lower edge into which a ball of a spring-loaded pivot assembly is received. Pushing or pulling on the handle on the opposite edge of the door similarly actuates its upper and lower vertical shafts, moves the upper and lower horizontal beams sidewardly in the other direction, and similarly secures the spring loaded pivot assembly on the opposite edge, whereby the door can be selectively opened from either side and in either direction.

A reversibly mounted cabinet door is described in U.S. Pat. No. 3,863,391 which has hinge pins at its upper and lower ends on each side thereof, the hinge pins being spring biased to extend beyond the peripheral edges of the door for disposition in hinge plates mounted on the cabinet adjacent to the upper and lower ends of each side of the door. A handle includes cam actuators which cooperate with the upper and lower hinge pins on the side on which the handle is mounted to retract these hinge pins from support in the hinge plates so that the door is hinged to the cabinet on the opposite side of the door from the handle.

U.S. Pat. No. 3,889,419 describes a door for a refrigerator which is capable of being opened in either a right-handed or a left-handed direction. The refrigerator cabinet has a hinge pin disposed in each corner of the opening, and the door is provided with two bolt assemblies having a bolt member which is slidable into entrapping engagement with the hinge pin in order to form a hinge mounting adjacent to either the left or the right hand side of the door. The door is also equipped with a pair of handles disposed on the right and left hand sides of the door for engaging the bolt assemblies in order to shift the bolts to form the hinge assembly on the side opposite to the handle that is actuated.

U.S. Pat. No. 4,222,149 discloses a door hinge arrangement that permits opening of the door alternatively at either side. This arrangement comprises mountings for attachment to the door at its upper and lower edges, each mounting carrying two hinge sets for engagement with hinge pivots fixed to the frame of the door. A longitudinally slidable trapping member is associated with each mounting. Each trapping member has a guide constructed so that when the door initially opens on one side, each trapping member is so displaced as to trap the corresponding hinge pivot in the hinge seat at the other side of the door, the hinge seats being located at the outer ends of the mountings and the trapping members having a length not exceeding the distance between the outer ends of the hinge seats. A guide is also arranged for displacing the trapping members in a direction away from the side at which the door is being opened.

A two-sided cabinet door, in which either side is pivotally openable and both sides are self-closing, is described in U.S. Pat. No. 4,230,381. The two-piece openable cover comprises a retaining lid and a captured lid which are intended to be joined together and mounted on top of the cabinet box having an upward facing opening needing to be covered. The retaining and the captured lids are interconnectable in either a pivotal or a sliding configuration; either lid may be separately opened, and both are self closing when pivotally connected. Either lid is also slideably openable when the lids are slideably connected.

U.S. Pat. No. 4,503,582 relates to a hinged structure for mounting a door to a cabinet for selective opening of the door from either side of the cabinet. This hinge structure includes a slide bar which is selectively positionable as a result of the opening of the door from either side of the cabinet to a thrown position. The structure also includes locking elements for retaining the slide bar in the thrown position as long as the door remains pivoted in the open position, thereby preventing the pivoting hinge structure from being removed from the cabinet.

In all of these devices of the prior art, the mechanisms are complicated and involve numerous parts. There is accordingly a need for a double-acting door structure which is simple in construction and operation and which comprises few parts.

It is to be understood that a door, as discussed hereinafter, has two surfaces and four edges, i.e., a front surface, a rear surface, a first side edge, a second side edge, a top edge, and a bottom edge. Each surface has two sides, extending from the middle to its first or to its second side edge. The front surface, for example, has a right side and a left side, and the right side is back-to-back with the left side of the rear surface. The door structure is defined as a double-acting door and a door frame which comprises a lintel in proximate relation to the top edge of the closed door and a sill in proximate relation to the bottom edge of the closed door.

SUMMARY OF THE INVENTION

It is a principal object of the present invention to provide a door structure for cabinets, refrigerators, and the like, wherein the door may be opened from either side of the front surface to expose the entire enclosed portion therein.

It is a further object of the present invention to provide a door structure for buildings, such as banks, department stores, and hospitals, which is pivotally mounted at opposite sides and capable of being opened from either side and in either direction.

Still a further object of the present invention is to provide a door structure which, when opened on either side of either surface, is correspondingly locked on the opposite side, so as to prevent the door from being opened simultaneously from both sides of either surface.

Other objects of the invention will be obvious to those skilled in the door art.

The above objects have been substantially achieved by employing a door having a plurality of vertically disposed and vertically slideable hinge members which are mounted within the door, between its front and rear surfaces. Each vertical member is situated to engage a corresponding locking mechanism mounted on the door frame of a cabinet or a refrigerator, for example. In engagement with the vertical members and affixed to inner portions of the door is a movable horizontal member which extends substantially the width of the door and is sufficient to engage sequentially the vertical members on either side of the door when the door is opened and subsequently when the door is closed and then opened from the other side. A mechanism, e.g., a handle, is conveniently affixed to each side of the outside of the door, such as, for example, the front surface, which, when actuated, will open the door from either side of that surface.

The door structure for the double-action pivoting door of this invention, which is selectively openable in either direction and automatically hingeable on either side within a door opening comprising a lintel and a sill, comprises:

A. two pairs of elongated, vertically disposed, and vertically slidable hinge members, each member having:
   (1) an outer end which has a vertically operable cam engaging means, and
   (2) an inner end which has a horizontally operable inner cam means;
B. a guide means for each hinge member;
C. a biasing means urging each hinge member outwardly;
D. an elongated, horizontally disposed, and horizontally slidable transverse member having two vertically operable cam engaging means on each end thereof, each cam engaging means being disposed in proximity to one of the inner ends and adapted for sliding engagement therewith;
E. a guide means for the transverse member; and
F. a pair of cam means which are mounted in the lintel and a pair of cam means which are mounted in the sill, whereby a force exerted transversely on one side of the door causes both cam engaging means on that side to slide over the cam means and move the hinge members inwardly for:
   (1) slideably engaging the two cam engaging means of the transverse member which are proximate thereto,
   (2) urging the transverse member toward the other side,
   (3) slideably engaging the remaining two cam engaging means with the inner cam means of the hinge members on the other side, and
   (4) urging the other hinge members outwardly so that their cam engaging means firmly enter the cam means in the lintel and in the sill and create a hinge for pivoting the door.

The horizontally sliding bar may be broadly described as a means for transforming a pair of vertically inward (i.e., toward each other) movements at one side of the door into a pair of vertically outward (i.e., away from each other) movements at the other side of the door.

The lengths and positions of the four hinge members and of the transverse member must be carefully designed. It is also desirable to have an adjusting means for each such member after installation in a door in order that the positions can be precisely set so that if the transverse member is between the four vertical members, i.e., not in contact with any of them, when two sides are simultaneously pushed or pulled, it will not be possible for all four hinge members to move onto their lintels and sills and enable the door to be moved bodily away from its pivoting position. Such a safety feature can be provided by designing the length of the transverse member to be too large for all four hinge members to be slid inwardly to the fullest extent for sliding over the lintel and sill on the opening side of the door.

An outside handle is needed for pulling the door so that it can open toward the user while being pivoted on the other side. However, when the door is opened by pushing, a handle need not be used.

BRIEF DESCRIPTION OF THE DRAWINGS

The invention will be more fully understood from the following detailed description of the embodiments described hereinafter, read in conjunction with the appended drawings

DETAILED DESCRIPTION OF THE DRAWINGS

Figure 1:
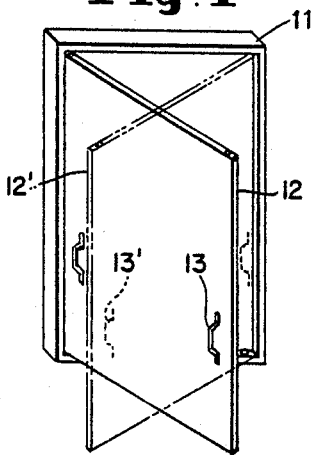
FIG. 1 is a perspective view of a device, such as a cabinet used in the present invention, partially in phantom, showing the door of the cabinet opened in opposite directions.
Figure 2:
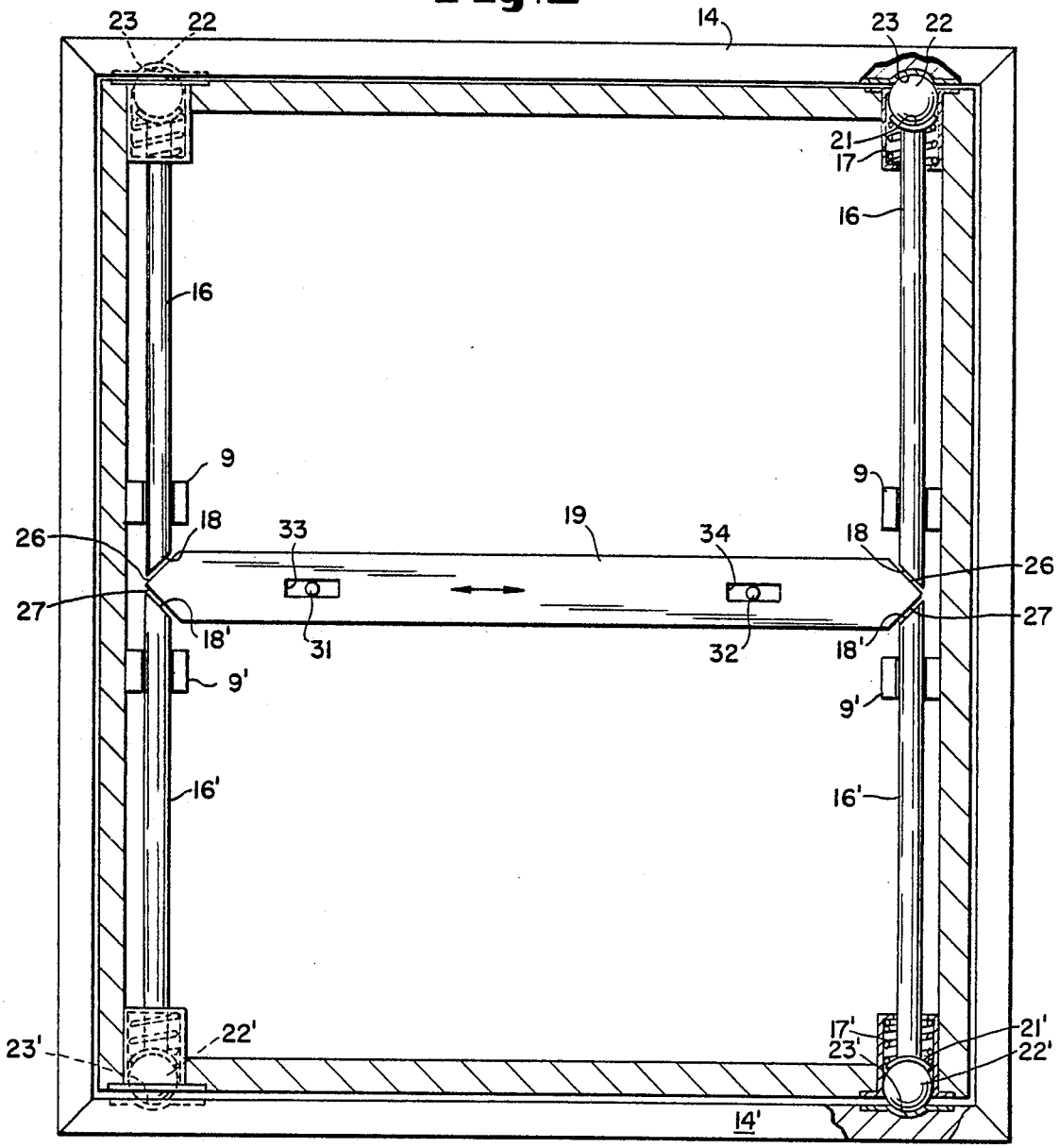
FIG. 2 is a front elevational view of the interior of the door with the front panel removed, illustrating the door structure which is utilized to control the opening of the door.

Referring to FIGS. 1 and 2, a door structure comprises a selectively hinged hollow door 12, a frame 11 having a lintel 14, a sill 14', and recesses 23 and 23' which function as cams. A handle 13 is attached to each side of the front surface of door 12 to facilitate the opening thereof from either its left side or its right side as door 12'.

The upper portion of the door structure shown in FIG. 2 comprises a pair of elongated, vertically disposed, and vertically slideable hinge members in the form of rods 16, each rod 16 having an outer end which has a vertically operable cam engaging means in the form a spherical ball 22 which operates within a suitably shaped rod outer end 21 and an inner end which has a horizontally operable inner cam means in the form of an inclined, face 18. The door structure further comprises a guide means 9 for each hinge member 16 and a biasing means, in the form of a compression spring 17, urging each rod 16 outwardly, i.e., vertically upwardly.

The preceding description applies to the upper portion of the door structure within door 12 and to the portion of the frame which interacts therewith. Exactly the same description can be given for the lower portion of the door structure, wherein exactly the same numbers are used except that they are in prime form, e.g., 16', and each biasing means 17' urges each lower rod 16' downwardly.

The door structure additionally comprises an elongated, horizontally disposed, and horizontally slideable transverse member in the form of a bar 19 having two vertically operable cam engaging means on each end thereof, each cam engaging means being adapted for sliding engagement with one of the inner cam faces 18 and 18', each cam engaging means being shown as an inclined edge 26 and 27. Bar 19 is provided with a guide means in the form of a pair of protruding pins 31 and 32 which are affixed to the interior of door 12 and adapted to engage respectively elongated horizontal openings 33 and 34 in bar 19.

The inner cam means for rods 16 and 16', i.e., the two pairs of inclined faces 18 and 18', operate upon the cam engaging means, i.e., the two pairs of inclined faces 26 and 27 within door 12 (i.e., between its front and rear surfaces) and on each side thereof. These cams alternately force bar 19 to one side or to the other as door 12 is hinged along its left side edge or as door 12' is hinged along its right side edge, as shown in FIG. 1.

Figures 3, 4:
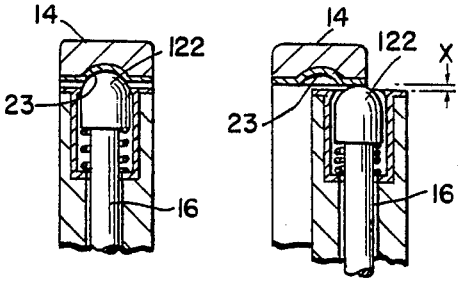
FIG. 3 is a similar view of an alternative embodiment of the cam means and the cam engaging means.
FIG. 4 shows the camming embodiment of FIG. 3 as it passes beneath a lintel.

Referring to FIG. 3, an alternative embodiment for cam engaging means 22 is shown as a suitably shaped cam engaging surface 122 at the end of a rod 16. Opening of the door from its left side while using its right side edge as its hinge edge, as illustrated by door 12' in FIG. 1, is shown while surface 122 slides over a portion of the adjacent lintel surface 14, thereby urging bar 16 downwardly through a distance X which is equal to the depth of cam 23.

Figure 5:
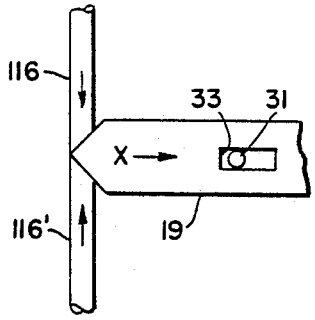
FIG. 5 shows the corresponding members for a left-side door opening as they are activated by the movement shown in FIG. 4 while engaging the transverse member at the left end thereof.

At the same moment in time as the movement shown in FIG. 4, the corresponding rod 16' on the left side of door 12' is passing over sill 14', and its inner cam 18' is moving upwardly through the same distance X. The result thereof is shown in FIG. 5 as rods 16 and 16' move inwardly, i.e., toward each other, and force bar 19 sidewardly through the distance X.

Figure 6:
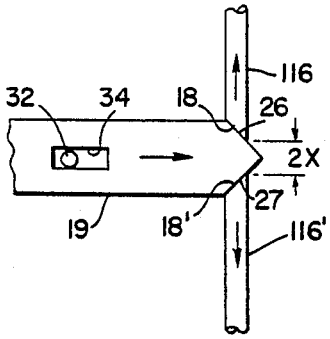
FIG. 6 shows the relationship of the inclined faces of the transverse member.. on its right end while actuated by the movement shown in FIGS. 4 and 5.

Also at the same moment in time, as shown in FIG. 6, the other end of bar 19, having also moved through the distance X, has engaged inclined faces 18 and 18' with its faces 26 and 27 and has thereby moved rods 16 and 16' outwardly through distance X for each rod, thereby separating them by a distance 2X, so that each outer end, as shown in FIG. 2 for balls 22 and 22', is firmly thrust into the respective cams 23 and 23' in the lintel and the sill at the right side edge of door 12'.

A door 12 of this invention is completely operable as hereinbefore described. For a small door, nothing further need be added. For a large door, where safety can be an important consideration, a means for locking the door to its hinged pivots, i.e., its cams 23, 23' at the hinge edge of door 12' may be desirable or even necessary.

Figure 7:
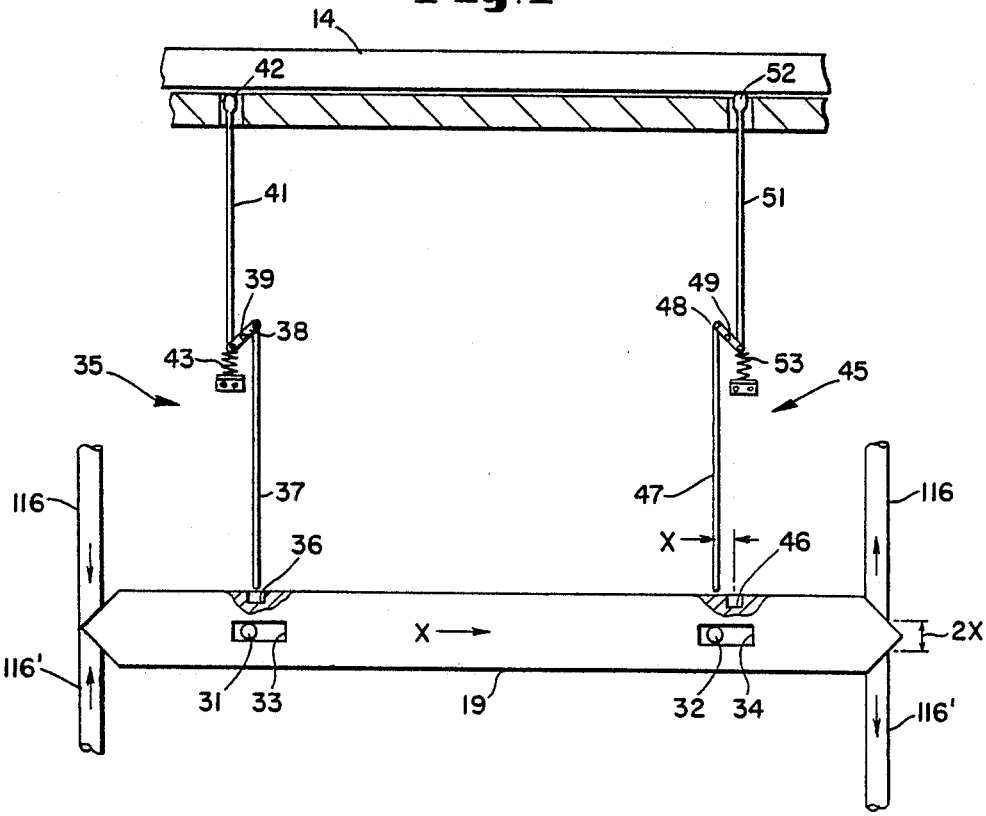
FIG. 7 is a partial front elevational view of the same door structure shown in FIG. 2, to which a preferred locking mechanism has been added.

A suitable locking means is shown in FIG. 7. It is operable only on bar 19 so that the remaining portions of the door structure are not illustrated. In FIG. 7, bar 19 is shown in the same position as in FIGS. 5 and 6.

Bar 19 is further provided with a pair of holes 36, 46. A pair of locking mechanisms 35 and 45 selectively engages holes 36 and 46 as bar 19 moves respectively to the left or to the right, as shown in FIG. 7.

Locking mechanisms 35 and 45 respectively comprise lower upright members 37 and 47, pivoting members 38 and 48 which pivot on their respective fulcrums 39 and 49, tension springs 43 and 53, and upper upright members 41 and 51 which have ends 42 and 52. Each lower member 37 and 47 has a bottom end which can enter a hole 36 and 46 and an upper end which is pivotally connected to one end of its adjacent pivoting member 38 and 48. Each upper member 41 and 51 has a lower end, which is pivotally connected to the other end of its adjacent pivoting member 38 and 48, and an upper en 42 and 52 which is preferably in a form of a cam engaging surface and may be a spherical ball, similar to ball 22. Such a ball should be able to co-act with a cam at the edge of lintel 14 and be recessable when acted upon by the cam so that pivoting member 48, for example, can pivot about its fulcrum 49 and raise lower member 47 out of hole 46.

It should be noted that hole 36 is shown in FIG. 7 as being spaced from lower member 37 by distance X which is equal to the distance that rods 16 and 16' move inwardly and the distance that bar 19 moves sidewardly, as seen in FIGS. 4 and 7. When door 12' is open, lower member 37 is seated within hole 36 so that the hinge at its right side edge is firmly secured. When door 12' is being shut, end 52 engages a cam at the edge of lintel 14 (not shown in the drawings) and is pushed downwardly so that middle member 38 pivots about its fulcrum 39 and lifts lower member 37 out of hole 36. Both mechanisms 35 and 45 are therefore out of their respective holes 36 and 46 as the door is being shut, but member 37 is positioned above hole 36, not sidewardly spaced therefrom by distance X as is member 47 with respect to hole 46.

Referring to FIG. 2, when door 12 is next pulled along its right side by handle 13, for example, so that the left side edge becomes the hinge edge, members 16 and 16' in the right side of door 12 move inwardly as their cam engaging means 22 and 22' respectively pass over lintel 14 and sill 14', as indicated in FIGS. 3 and 4. Bar 19 is forced to move to the left as members 16 and 16' move inwardly and toward each other, so that inclined faces 26 and 27 on the left end of bar 19 engage the inclined faces 18 and 18' of rods 16 and 16' near the left side edge of door 12 and force balls 22 and 22' at their ends outwardly into cams 23 and 23' in lintel 14 and sill 14', respectively, thereby forcibly establishing a hinge means for door 12.

It should be understood that when door 12 is being opened with the left side edge as the hinge edge, end 52 does not contact lintel 14 as it passes beneath lintel 14, but immediately thereafter, the lower end of member 47 is able to drop into hole 46 as bar 19 simultaneously slides to the left to lock rods 16 and 16' into position as hinge members and end 52 simultaneously moves upwardly so that it protrudes above the top edge of the door.

This invention is not limited to its use in cabinets, but may be employed in all types of doors, windows, closets, and refrigerators, and for all structures where it is desired to have access from both sides. It is additionally usable from both front and back surfaces, with or without handles.

Other modifications of components of the door structure may also be substituted for those described hereinbefore. For example, each end of bar 19 may be provided with cam followers, such as nylon pins, instead of inclined faces 26 and 27 for engaging cam faces 18 and 18'. As another example, bar 19 may be operated without using cams; e.g., it may be slid horizontally by two pairs of inclined rods, each of which is pivotally attached at one end to one of its ends, the other end of each inclined rod being pivotally attached to an inner end of a rod 16 or 16'. As another example, a pair of solenoids may be used to extend or withdraw a cam-type means for engaging inclined cam faces 18 and 18'. Electrical current for the solenoids may be supplied through balls 22 and 22', with opening of door 12 and 12' causing one solenoid to be retracted for one side and the other solenoid to be extended for the other side.

Because it will be readily apparent to those skilled in the door art that innumerable variations, modifications, applications, and extensions of the examples and principles hereinbefore set forth can be made without departing from the spirit and the scope of the invention, what is hereby defined as such scope and is desired to be protected should be measured, and the invention should be limited, only by the following claims.

What is claimed is:

1. A door structure for a double-action pivoting door, having two surfaces, a top edge, a bottom edge, and two side edges, each said surface having a left side and a right side, which can be opened in either direction by pushing or by pulling along either said side edge without using a handle and is automatically hingeable near either said side edge within a door opening comprising a lintel and a sill to create an opening side edge and a hinge side edge, said door structure comprising:

A. two pairs of elongated, vertically disposed, and vertically slideable hinge members, each member having a vertically operable cam engaging means at its outer end for selectively creating a pair of vertically inward movements, through a distance X, of one pair of said hinge members at said opening side edge, said inward movements being initiated by said pushing or pulling;

B. a biasing means urging each said hinge member outwardly;

C. a pair of cam means in said lintel and a pair of cam means in said sill which are disposed and adapted to interact with said two pairs of said cam engaging means for selectively forming a hinge at said hinge side edge; and D. a means for transforming said pair of vertically inward movements through said distance X of said one pair of hinge members near said opening side edge into a pair of vertically outward movements through said distance X of said other pair of hinge members at said hinge side edge without utilizing said handle, whereby said hinge members at said hinge side edge firmly enter one of said lintel cams and one of said sill cams and form said hinge.

2. The door structure of claim 1, wherein said vertically operable cam engaging means is a spherical ball.

3. A door structure for a double-action pivoting door which can be opened in either direction and is automatically hingeable near either side edge thereof within a frame comprising a lintel and a sill to create a hinge side edge and an opening side edge, said door structure comprising:

A. two pairs of cam recesses which are mounted in said lintel and in said sill;

B. two pairs of elongated, vertically disposed, and vertically slideable rods, each rod having (1) an outer end which has a vertically operable cam engaging means for selectively engaging one of said cam recesses, whereby each said pair of rods is slideable outwardly and inwardly and (2) an inner end which has an inner cam means for exerting a force in a horizontal direction, said inner ends being separated, when said rods are outwardly slid, by a distance equal to at least twice the distance of said sliding;

C. a biasing means urging each said rod outwardly;

D. an elongated, horizontally disposed, and horizontally slideable transverse bar which is supported by a guide means and has two cam engaging means at each end thereof, each said cam engaging means being in sliding engagement with one of said inner cam means, whereby, when said door is pushed or pulled near said opening side edge, each said cam engaging means near said opening side edge receives said horizontally exerted force from one of said inner cam means, causing said transverse bar to be slid horizontally and each said cam engaging means at the other end of said bar to exert a force in a vertical direction upon one of said other pair of rods along said hinge side edge, thereby automatically establishing said hinge in one said pair of cam recesses; and E. a means for locking said transverse bar which comprises a locking mechanism which is selectively operable on said bar, said locking mechanism comprising:

(1) a lower upright member having an upper end and a bottom end:

(2) a pivoting member which is pivotally attached at one end to the upper end of said lower upright member and which pivots about a fulcrum;

(3) an upper upright member, having an upper end and a lower end, which has a cam engaging means at said upper end and is pivotally connected at said lower end to the other end of said pivoting member;

(4) cam means in said lintel;

(5) a locking hole in said bar which is adapted to receive said bottom end; and (6) a biasing means for pushing said bottom end into said locking hole.

4. The door structure of claim 3, wherein said vertically operable cam engaging means is a spherical ball.

5. The door structure of claim 3, wherein said biasing means for said hinge members is a compression spring.

6. The door structure of claim 3, wherein said cam engaging means of said transverse bar is a pair of inclined faces which are inclined at 45° to said transverse bar.

7. The door structure of claim 3, wherein said guide means for said transverse bar is an elongated opening in said transverse bar and a protruding pin which is attached to a rigid portion of said door.

8. The door structure of claim 3 which further comprises an additional locking mechanism comprising an additional locking hole in said bar, each said locking mechanism being disposed near one said side edge of said door.

9. The door structure of claim 8, wherein said holes are spaced apart by a distance that is less than the distance separating said lower upright members by the distance of said inward movement.

10. A door structure for a double-action pivoting door, having a left side edge, a right side edge, a front surface, and a rear surface, each said surface a left side and a right side, which can be selectively opened in either direction by pushing or by pulling near either said side edge and is automatically hingeable near either said side edge within a door opening comprising a lintel and a sill to create an opening side edge and a hinge side edge, said door structure comprising:

A. two pairs of elongated, vertically disposed, and vertically slidable hinge members, each member having:

(1) an outer end which has a spherical ball as a vertically operable cam engaging means, and (2) an inner end which has horizontally pushing inclined face which is inclined at 45° to said member;

B. a guide means for each said hinge member;

C. a biasing means urging each said hinge member outwardly;

D. an elongated, horizontally disposed, and horizontally slidable transverse member having two vertically pushing cam faces on each end thereof, each said cam face being disposed for sliding engagement with one of said horizontally pushing faces;

E. a guide means for said transverse member; and

F. a pair of cam recesses in said sill and a pair of cam recesses in said lintel for receiving said spherical balls, whereby a force exerted transversely on one surface of said pivoting door and near said opening side edge causes both said spherical balls near said side opening edge to slide over both said cam recesses and move said hinge members inwardly for: (1) slideably engaging said two cam faces of said transverse member which are proximate thereto (2) pushing said transverse member toward said other side, (3) slideably engaging said remaining two vertically pushing cam faces with said horizontally pushing cam faces of said other hinge members, and (4) urging said other hinge members outwardly so that said spherical balls near said hinge side edge firmly enter said cam recesses in said lintel and in said sill and create a hinge for pivoting said door.

11. The door structure of claim 10, wherein said biasing means for each said hinge member is a compression spring.

12. The door structure of claim 10, wherein said guide means for said transverse member is an elongated opening in said transverse member and a protruding pin which is attached to a rigid portion of said door.

13. A door structure for a double-action pivoting door having two side edge which selectively function as either an opening side edge or a hinge side edge, said door being operable within a door frame comprising a lintel and a sill, said door structure comprising:

A. a pair of cam means in said lintel and a pair of cam means in said sill, each said cam: means being substantially vertically aligned with one said side edge;

B. two pairs of vertically aligned cam-engaging means in said door, each pair being vertically aligned with one said cam means in said lintel and with one said cam means in said sill;

C. means for automatically forming a hinge at said hinge side edge when said door in closed position is pushed or pulled near the other said side edge, which thereby functions as said opening side edge, to cause unseating of one said pair of cam-engaging means from said cams in said lintel and in said sill at said opening side edge and seating of said pair of cam-engaging means into said cams in said lintel and said sill at said hinge side edge; and D. front and rear surface which are in parallel and disposed between said side edges, said door being openable by pushing against either said surface without using a handle and said hinge forming means being operably unconnected to said handle.

* * * * *